United States Patent [19]

Spears

[11] Patent Number: 4,599,054

[45] Date of Patent: Jul. 8, 1986

[54] TRAVELLING VALVE ASSEMBLY FOR A FLUID PUMP

[76] Inventor: Harry L. Spears, 6307 Glenhill, Spring, Tex. 77379

[21] Appl. No.: 643,843

[22] Filed: Aug. 23, 1984

[51] Int. Cl.[4] ..... F04B 39/10; F04B 7/00

[52] U.S. Cl. ..... 417/456; 417/511; 417/520

[58] Field of Search ..... 417/443, 444, 456, 510, 417/511, 434, 554, 520

[56] References Cited

U.S. PATENT DOCUMENTS

| | | | |
|---|---|---|---|
| 1,067,312 | 7/1913 | Conrader | 417/451 |
| 1,442,960 | 1/1923 | McKissick | 166/318 |
| 1,518,865 | 12/1924 | McKissick | 166/318 |
| 1,555,230 | 9/1925 | Penrod et al. . | |
| 1,574,080 | 2/1926 | Gates . | |
| 1,574,081 | 2/1926 | Gates . | |
| 1,576,597 | 3/1926 | Goss | 417/445 |
| 1,685,650 | 9/1928 | Streich | 417/443 |
| 2,180,158 | 11/1939 | McCoy | 417/514 |
| 2,674,955 | 4/1954 | Hilton | 417/456 |
| 2,690,134 | 9/1954 | Ritchey | 417/447 |
| 2,933,050 | 4/1960 | Crowl et al. | 417/456 |
| 3,055,764 | 9/1962 | Pryor et al. | 417/444 |
| 3,139,039 | 6/1964 | Adams | 417/511 |
| 3,186,354 | 6/1965 | Mahoney | 417/456 |

*Primary Examiner*—William L. Freeh

*Attorney, Agent, or Firm*—Ben D. Tobor

[57] ABSTRACT

A travelling valve assembly for use in a sucker rod actuated fluid pump includes a ball valve actuator which engages the ball valve during the downstroke of the sucker rod to force the ball valve into an open fluid transmitting relationship with respect to its valve seat.

19 Claims, 3 Drawing Figures

Fig. 1
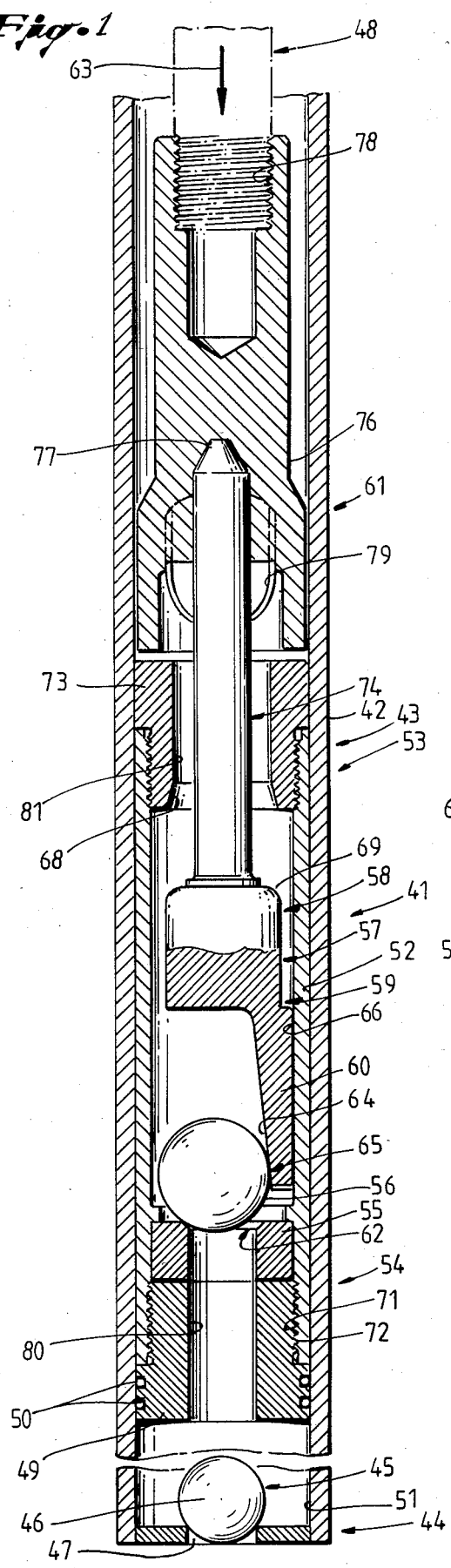
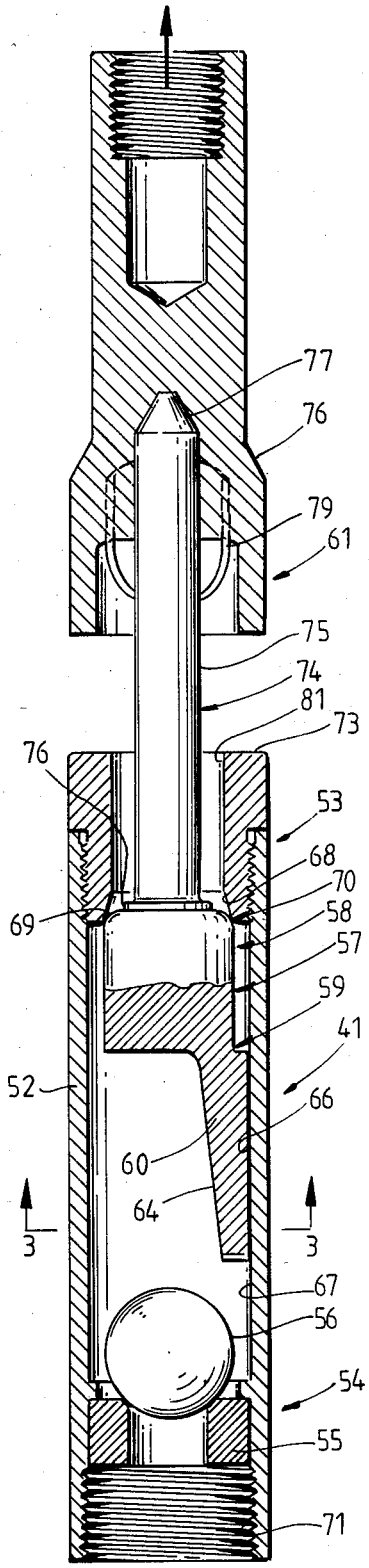
Fig. 2
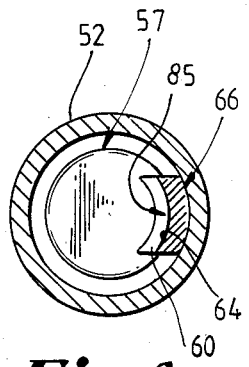
Fig. 3

TRAVELLING VALVE ASSEMBLY FOR A FLUID PUMP

FIELD OF THE INVENTION

The invention relates to a travelling valve assembly for a fluid pump for elevating fluids, and in particular, to a travelling valve assembly for a fluid pump for raising petroleum fluids through production tubing in completed oil wells.

DESCRIPTION OF THE PRIOR ART

A conventional oil well includes a cased well bore with one or more strings of tubing extending downwardly through the casing into the oil or other petroleum fluid contained in the sub-surface mineral formation to be produced. The casing is perforated at the level of the production zone to permit fluid flow from the formation into the casing, and the lower end of the tubing string is generally open to provide entry for the fluid into the tubing.

One type of pump conventionally employed in structures of the type described is wedged into an internal constriction or seating nipple formed internally of the tubing below the fluid level. A metallic enlargement on the external body of the pump prevents it from travelling below the seating nipple and resilient seal rings on the body of the pump housing, or pump barrel, act to form a leak proof seal between the seating nipple and pump housing, or barrel. The pump is generally driven by a mechanical linkage of metal rods, generally referred to as sucker rods, or valve rods, which extend from the pump to the well surface. The valve rod, or sucker rod, linkage is powered in a reciprocating motion by a conventional mechanical apparatus, usually called a pumping unit located at the well surface.

The conventional pump itself generally includes a housing through which a piston is reciprocated by the sucker rod, or valve rod, linkage. In its simplest form, the conventional pump of the type described often includes a number of ball and seat valves with one such valve in, or above, the piston and another at the inlet port of the housing or barrel. On the upstroke of the plunger, the ball in the inlet port valve is drawn away from its seat and the ball of the outlet port valve is forced over its seat to draw fluid from below the sealing nipple and into the housing. On the piston's downstroke, the ball in the inlet valve is forced onto its seat and the ball in the piston valve moves away from its seat to allow the piston to move downwardly through the fluid contained in the housing. On the subsequent upstroke, the closing of the piston valve forces the fluid above the piston out of the housing through the outlet ports and into the tubing above the sealing nipple and simultaneously fills the housing below the piston with fluid. Repetition of this cycle eventually fills the tubing string and causes the fluid to flow to the surface.

The previously described pump or some variation thereof is probably the most widely employed in applications where it is desired to drive a sub-surface pump by a surface powered, mechanical linkage. A significant problem in pumps of this type is generally known as "gas locking" as will be hereinafter described. In such conventional pumps, the fluid head pressure in the tubing string is held by the outlet port valve, or a travelling valve, on the upstroke of the piston and by the inlet port valve, or lower standing valve, on the downstroke thereof. The downstroke of the travelling valve builds up pressure on the fluid between the travelling valve and standing valve which causes the travelling valve to open to allow fluid to pass above the travelling valve, or outlet port valve. However, in a well producing both oil and gas, the chamber between the travelling valve and the standing valve, frequently fills with gas. Due to the compressibility of the gas, the downstroke of the travelling valve may not build up sufficient pressure in the chamber below said valve to equal the pressure of the fluid column above the travelling valve, thus resulting in the travelling valve remaining closed during its downstroke. Thus, the gas between the standing valve and travelling valve merely compresses and expands with each stroke of the pump, producing the operational failure of the pump known as "gas locking." This condition may remedy itself after a short time or may continue indefinitely.

A new type of sub-surface oilfield pump, including a unique travelling valve assembly has recently been introduced and is described in applicant's co-pending U.S. patent application Ser. No. 487,287, filed Apr. 21, 1983 U.S. Pat. No. 4,504,199 issued Mar. 12, 1985. Although this sub-surface pump, including its travelling valve assembly, solves the "gas-locking" problem previously described, among others, such pump can experience certain problems in some types of geological formations. Specifically, some wells have carbon dioxide injected into the formation to pressurize the well to assist the production of hydrocarbons from the well. The fluid pump and travelling valve assembly disclosed in applicant's co-pending application, may utilize for some of the components thereof, certain metal components which have undergone metal treating processes to harden certain surfaces of such components. The carbon dioxide being utilized in certain geological formations has had a tendency to attack such hardened surfaces and can cause deterioration thereof which can lead to failure of the pump, and thus lead to frequent replacement of various components within the pump.

Accordingly, prior to the development of the present invention, there has been no travelling valve assembly for a sucker rod actuated fluid pump for raising petroleum fluids through production tubing in completed oil wells which: eliminate "gas locking"; and is not readily susceptible to damage caused by carbon dioxide contained in the well fluid being pumped, and thus is economical to use without frequent replacement of valve components. Therefore, the art has sought a travelling valve assembly for a sucker rod actuated fluid pump for raising petroleum fluids through production tubing in completed oil wells which eliminates "gas locking", and is not substantially affected by carbon dioxide contained within the fluid to be pumped, thus being more economical to use.

SUMMARY OF THE INVENTION

In accordance with the present invention, the foregoing advantages have been achieved through the present travelling valve assembly, for use in a sucker rod actuated fluid pump which has a pump barrel having upper and lower ends with a standing valve disposed in the lower end of the pump barrel and a moveable piston disposed within the pump barrel. The present invention includes: a housing having upper and lower ends, the housing adapted to be disposed within the upper end of the pump barrel; a valve seat disposed in the lower end of the housing above the piston within the pump barrel;

a ball valve disposed above the valve seat and having a first open, fluid transmitting position with respect to the valve seat and a second sealed, fluid non-transmitting position with respect to the valve seat; a ball valve actuator having upper and lower ends and generally disposed above the ball valve within the housing, the actuator having at least one downwardly depending member at its lower end which said at least one member has an actuation surface thereon for selective engagement with the ball valve; and means for selectively moving the actuator and the at least one depending member from a first position, where the actuation surface of the at least one member engages the ball valve and moves the ball valve into the first open, fluid transmitting position where the actuation surface is spaced from the ball valve, whereby the ball valve is in the second sealed, fluid non-transmitting position with respect to the valve seat.

A further feature of the present invention is that the actuation surface of the at least one downwardly depending member of the ball valve actuator may taper upwardly toward the upper end of the ball valve actuator. An additional feature of the present invention is that the actuation surface may also have a semi-circular configuration with cooperates and mates with the ball valve.

Another feature of the present invention is that a valve seating surface may be disposed at the upper end of the housing and the upper end of the ball valve actuator has a sealing surface which cooperates with the valve seating surface to seal the upper end of the housing after the ball valve has moved into the second sealed, fluid non-transmitting position with respect to the valve seat.

The travelling valve assembly of the present invention, when compared with previously proposed prior art travelling valve assemblies for fluid pumps, has the advantages of eliminating "gas locking", and reduces the problems associated with carbon dioxide in the fluid to be pumped.

BRIEF DESCRIPTION OF THE DRAWINGS

In the drawings:

FIG. 1 is a cross-sectional view along the longitudinal axis of a travelling valve assembly in the downstroke position in accordance with the present invention;

FIG. 2 is another cross-sectional view along the longitudinal axis of the travelling valve assembly in the upstroke position of the present invention; and FIG. 3 is a cross-sectional view of the travelling valve assembly taken along line 3—3 of FIG. 2;

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

In FIGS. 1 and 2, a travelling valve assembly 41 in accordance with the present invention, is shown disposed within a conventional pump barrel, or housing, 42, having upper and lower ends 43, 44. Disposed at the lower end 44 of pump barrel 42 is a conventional standing valve 45, or ball check valve and seat 46, 47. For drawing clarity, pump barrel 42 and standing valve 45 have been deleted from FIG. 2. Pump barrel 42 forms a part of a conventional sucker rod, or valve rod, actuated fluid pump, as is well known in the art. A conventional sucker rod, or valve rod, 48 is shown in phantom lines in FIG. 1. As is well known in the art such conventional fluid pumps utilize a moveable piston, or plunger, 49 disposed within the pump barrel 42 in a sliding, sealing relationship via O-ring seals 50 disposed in the outer surface of piston 49 in sealing relationship with the interior surface 51 of pump barrel 42. For drawing clarity, piston, or plunger, 49 has been deleted from FIG. 2.

Still with reference to FIGS. 1 and 2, a travelling valve assembly 41 in accordance with the present invention, is shown to generally comprise: a housing 52 having upper and lower ends 53, 54, the housing being adapted to be disposed within the upper end 43 of the pump barrel 42; a valve seat 55 disposed in the lower end 54 of housing 52 above the piston 49 within the pump barrel 42; a ball valve 56 disposed above the valve seat 55; a ball valve actuator 57 having upper and lower ends 58, 59 and generally disposed above the ball valve 56 within housing 52, the ball valve actuator 57 having at least one downwardly depending member 60 disposed at its lower end 59; and means for selectively moving 61 the actuator 57 and the at least one depending member 60 from a first position to a second position as will be hereinafter described in greater detail.

With reference to FIG. 1, it is seen that ball valve 56 is disposed in a first open, fluid transmitting position, generally as shown at 62, with respect to the valve seat 55. As denoted by arrow, 63 in FIG. 1, the configuration of travelling valve assembly 41 in FIG. 1 corresponds to the point in time when sucker rod, or valve rod, 48 is travelling through its downstroke movement, as will be hereinafter described in greater detail. During the downstroke movement of sucker rod 48, lower standing valve 45 is closed as illustrated in FIG. 1, due to the compression of the fluid (not shown) contained in the lower end 44 of pump barrel 42 by the downward movement of piston 49, as will be hereinafter described in greater detail. Because ball valve 56 is disposed in its first open, fluid transmitting position, as shown at 62, with respect to valve seat 55, the fluid being compressed by piston 49 can flow upwardly past ball valve 56 and upwardly out of housing 52 and through pump barrel 42 into the production tubing string (not shown), as will be hereinafter described.

With reference to FIG. 2, travelling valve assembly 41 is illustrated in its configuration while sucker rod 48 is moving upwardly during its upstroke movement. During the upstroke of sucker rod 48, as will be hereinafter described in greater detail, ball valve 56 is shown disposed in its second sealed, fluid non-transmitting position with respect to valve seat 55. During the upstroke of sucker rod 48, plunger 49 would also be moving upwardly and the vacuum created by such upward movement within barrel 42 causes lower standing valve 45 to open to allow fluid to flow into the lower end 44 of barrel 42, as is conventional in the art.

With reference to FIGS. 1, 2, and 3, it is seen that the at least one downwardly depending member 60 has an actuation surface 64 which selectively engages ball valve 56 as shown at 65 in FIG. 1. Actuation surface 64 of the at least one downwardly depending member 60 tapers upwardly toward the upper end 58 of the ball valve actuator 56. Preferably, as shown in FIG. 3, actuation surface 64 has a semi-circular configuration 85 which cooperates and mates with the ball valve 56, as ball valve actuator 57 moves downwardly within housing 52 as illustrated in FIG. 1. In general, actuation surface 64 adjacent ball valve 56, as illustrated in FIG. 1, as shown at 65, is disposed in a plane which is spaced from the longitudinal axis of the pump barrel 42. Alternatively, actuation surface 64 may be disposed in a plane which is generally parallel with the longitudinal axis of the pump barrel 42, and actuation surface 64 is disposed in a plane spaced from the longitudinal axis of the pump barrel. Although only one downwardly depending member 60 for ball valve actuator 57 is illustrated in FIGS. 1-3, it should be readily apparent to one skilled in the art that additional downwardly depending members 60 could be added to ball valve actuator 57, provided that such additional downwardly depending members 60 and their respective actuation surfaces, do not prohibit the movement of ball valve 56 into its first open, fluid transmitting position as illustrated at 62 in FIG. 1.

With reference to FIGS. 1 and 2, it is seen that ball valve actuator 57 may be provided with a guide surface 66 disposed thereon in a sliding relationship with at least a portion of the interior surface 67 of housing 52. Preferably, guide surface 66 may disposed on the downwardly depending member 60. Thus, upon the downward movement of ball valve actuator 57 into the position shown in FIG. 1, guide surface 66 serves to insure that actuation surface 64 of downwardly depending member 60 properly engages ball valve 56 in order to move ball valve 56 to its first open, fluid transmitting position as shown at 62 in FIG. 1. Alternatively, guide surface 66 could be disposed on the outer surface of ball valve actuator 57.

Still with reference to FIGS. 1 and 2, housing 52 may be provided with a valve seating surface 68 disposed at the upper end 53 of housing 52. Upper end 58 of the ball valve actuator 57 can likewise be provided with a sealing surface 69 which cooperates with the valve seating surface 68 to seal the upper end 53 of the housing after the ball valve 56 has moved into its second sealed, fluid non-transmitting position with respect to valve seat 55, as illustrated in FIG. 2 at 70. Thus, as illustrated in FIG. 2, upon sucker rod 48 moving during its upstroke, not only does ball valve 56 of travelling valve assembly 41 achieve its second sealed, fluid non-transmitting position with respect to valve seat 55, but additional, auxiliary sealing is provided as at 70 between valve seating surface 68 and sealing surface 69, whereby the required suction force is developed by the upward movement of plunger 49 within pump barrel 42. It should be noted that housing 52 is provided in a conventional manner with screw threads 71 and piston 49 is provided with corresponding screw threads 72 whereby piston, or plunger, 49 may be threadedly received in the lower end 54 of housing 52. Preferably, the upper end of housing 52 is provided with an end cap 73 threadedly received at the upper end 53 of housing 52, and valve seating surface 68 can be provided on the interior surface of end cap 73.

As illustrated in FIGS. 1 and 2, the means for selectively moving 61 the ball valve actuator 57 and the at least one depending member 60 moves them from a first position, as illustrated in FIG. 1, where the actuation surface 64 of the at least one downwardly depending member 60 engages the ball valve 56 and moves the ball valve 56 into its first open, fluid transmitting position with respect to the valve seat 55, to a second position, as illustrated in FIG. 2, wherein the actuation surface 64 is spaced from the ball valve 56, whereby the ball valve 56 is in the second sealed, fluid non-transmitting position with respect to the valve seat 55. Preferably, the means for selectively moving 61 the ball valve actuator 57 and the at least one downwardly depending member 60 comprises a sucker rod connector assembly 74 secured to the upper end 58 of the ball valve actuator 57, and a portion of the connector assembly 74 is adapted to be disposed within the housing 52. Sucker rod connector assembly 74 is seen to generally comprise a connector rod 75, which is preferably threadedly received into the upper end 58 of ball valve actuator 57, as at 76, and a sucker rod connector member 76 which threadedly receives the upper end of rod connector 75, as at 77. Sucker rod connector 76 is preferably provided with a threaded connection as at 78 to threadedly receive sucker-rod 48, as seen in FIG. 1. Sucker rod connector 76 is further preferably provided with at least one, and preferably two, fluid ports 79 as illustrated in FIGS. 1 and 2 in dotted lines. Fluid moving upwardly through fluid passageway 80 of plunger 49, through valve seat 55 and past ball valve 56 and through fluid passageway 81 of end cap 73 can continue its upward movement through fluid ports 79 and into pump barrel 42 and thus through the production tubing (not shown).

If during the downstroke of sucker rod 48, as illustrated in FIG. 1, gas is present in the fluid being compressed in the lower end 44 of pump barrel 42 by piston 49, the ball valve actuator 57 insures that the ball valve 56 will be engaged by the actuation surface 64 of downwardly depending member 60, whereby ball valve 56 will automatically assume its first open, fluid transmitting position with respect to the valve seat 55, thus eliminating any problems associated with "gas locking". It should be further noted that the construction of the travelling valve assembly 41 of the present invention does not require any metal treatment to harden surfaces, whereby the presence of carbon dioxide within the fluid being pumped will not unduly harm the travelling valve assembly of the present invention.

It is to be understood that the invention is not limited to the exact details of construction, operation, exact materials, or embodiment shown and described, as obvious modifications and equivalents will be apparent to one skilled in the art. For example, an intermediate spring biased wedge member could be disposed adjacent the ball valve, which wedge member could be forced into engagement with the ball valve by the wedge member being contacted by the downwardly depending member to cause the ball valve to be wedged to its first open, fluid transmitting position with respect to the valve seat. Accordingly, the invention is therefore to be limited only by the scope of the appended claims.

I claim:

1. A travelling valve assembly, for use in a sucker-rod actuated fluid pump having a pump barrel having upper and lower ends with a standing valve disposed in the lower end of the pump barrel and a moveable piston disposed within the pump barrel, comprising:

a housing having upper and lower ends, said housing adapted to be disposed within the upper end of the pump barrel;

a valve seat disposed in the lower end of the housing above the piston within the pump barrel;

a ball valve disposed above the valve seat and having a first open, fluid transmitting position with respect to the valve seat and a second sealed, fluid non-transmitting position with respect to the valve seat;

a ball valve actuator having upper and lower ends and generally disposed above the ball valve within the housing, the actuator having at least one downwardly depending member at its lower end which said at least one member has an actuation surface thereon for selective engagement with the ball valve; and means for selectively moving the actuator and the at least one depending member from a first position, where the actuation surface of the at least one member engages the ball valve and moves the ball valve into the first open, fluid transmitting position with respect to the valve seat, to a second position where the actuation surface is spaced from the ball valve, whereby the ball valve is in the second sealed, fluid non-transmitting position with respect to the valve seat.

2. The travelling valve assembly of claim 1, wherein the means for selectively moving the actuator and at least one member comprises a sucker-rod connector assembly secured to the upper end of the actuator, a portion of said connector assembly adapted to be disposed within the housing.

3. The travelling valve assembly of claim 1, wherein the actuation surface of the at least one downwardly depending member of the ball valve actuator tapers upwardly toward the upper end of the ball valve actuator.

4. The travelling valve assembly of claim 3, wherein the actuation surface further has a semi-circular configuration which cooperates and mates with the ball valve.

5. The travelling valve assembly of claim 3, wherein the actuation surface adjacent the ball valve is disposed in a plane which is spaced from the longitudinal axis of the pump barrel.

6. The travelling valve assembly of claim 1, wherein the actuation surface of the at least one downwardly depending member of the ball valve actuator is generally parallel with the longitudinal axis of the pump barrel, and is disposed in a plane spaced from said longitudinal axis.

7. The travelling valve assembly of claim 6, wherein the actuation surface further has a semi-circular configuration which cooperates and mates with the ball valve.

8. The travelling valve assembly of claim 1, wherein a valve seating surface is disposed at the upper end of the housing and the upper end of the ball valve actuator has a sealing surface which cooperates with the valve seating surface to seal the upper end of the housing after the ball valve has moved into the second sealed, fluid non-transmitting position with respect to the valve seat.

9. The travelling valve assembly of claim 1, wherein the ball valve actuator has a guide surface disposed thereon in a sliding relationship with at least a portion of the interior surface of the housing.

10. The travelling valve assembly of claim 9, wherein the guide surface is disposed on the downwardly depending member.

11. A travelling valve assembly, for use in a sucker-rod actuated fluid pump having a pump barrel having upper and lower ends with a standing valve disposed in the lower end of the pump barrel and a moveable piston disposed within the pump barrel, comprising:

a housing having upper and lower ends, said housing adapted to be disposed within the upper end of the pump barrel;

a valve seat disposed in the lower end of the housing above the piston within the pump barrel;

a ball valve disposed above the valve seat and having a first open, fluid transmitting position with respect to the valve seat and a second sealed, fluid non-transmitting position with respect to the valve seat;

a ball valve actuator having upper and lower ends and generally disposed above the ball valve within the housing, the actuator having at least one downwardly depending member at its lower end which said at least one member has an actuation surface thereon for selective engagement with the ball valve;

means for selectively moving the actuator and the at least one depending member from a first position, where the actuation surface of the at least one member engages the ball valve and moves the ball valve into the first open, fluid transmitting position with respect to the valve seat, to a second position where the actuation surface is spaced from the ball valve, whereby the ball valve is in the second sealed, fluid non-transmitting position with respect to the valve seat; and a valve seating surface disposed at the upper end of the housing and the upper end of the ball valve actuator has a sealing surface which cooperates with the valve seating surface to seal the upper end of the housing after the ball valve has moved into the second sealed, fluid non-transmitting position with respect to the valve seat.

12. The travelling valve assembly of claim 11, wherein the means for selectively moving the actuator and at least one member comprises a sucker-rod connector assembly secured to the upper end of the actuator, a portion of said connector assembly adapted to be disposed within the housing.

13. The travelling valve assembly of claim 11, wherein the actuation surface of the at least one downwardly depending member of the ball valve actuator tapers upwardly toward the upper end of the ball valve actuator.

14. The travelling valve assembly of claim 13, wherein the actuation surface further has a semi-circular configuration which cooperates and mates with the ball valve.

15. The travelling valve assembly of claim 13, wherein the actuation surface adjacent the ball valve is disposed in a plane which is spaced from the longitudinal axis of the pump barrel.

16. The travelling valve assembly of claim 11, wherein the actuation surface of the at least one downwardly depending member of the ball valve actuator is generally parallel with the longitudinal axis of the pump barrel, and is disposed in a plane spaced from said longitudinal axis.

17. The travelling valve assembly of claim 16, wherein the actuation surface further has a semi-circular configuration which cooperates and mates with the ball valve.

18. The travelling valve assembly of claim 11, wherein the ball valve actuator has a guide surface disposed thereon in a sliding relationship with at least a portion of the interior surface of the housing.

19. The travelling valve assembly of claim 18, wherein the guide surface is disposed on the downwardly depending member.

* * * * *